US007699668B2

(12) United States Patent
Lendi

(10) Patent No.: US 7,699,668 B2
(45) Date of Patent: Apr. 20, 2010

(54) PLUG-IN MODULE

(75) Inventor: Michael Lendi, Mels (CH)

(73) Assignee: Cedes Safety & Automation AG, Landquart (CH)

( * ) Notice: Subject to any disclaimer, the term of this patent is extended or adjusted under 35 U.S.C. 154(b) by 0 days.

(21) Appl. No.: 11/942,995

(22) Filed: Nov. 20, 2007

(65) Prior Publication Data

US 2008/0119083 A1 May 22, 2008

(30) Foreign Application Priority Data

Nov. 22, 2006 (DE) ..... 20 2006 017 882 U

(51) Int. Cl.
*H01R 9/22* (2006.01)

(52) U.S. Cl. ..... 439/712

(58) Field of Classification Search ..... 439/712, 439/713, 709, 715, 716
See application file for complete search history.

(56) References Cited

U.S. PATENT DOCUMENTS 3,757,281 A * 9/1973 Woertz et al. ..... 439/724
4,171,861 A * 10/1979 Hohorst ..... 439/94
4,227,238 A * 10/1980 Saito ..... 361/801
4,776,815 A * 10/1988 Baillet et al. ..... 439/724
4,929,186 A * 5/1990 Steinkuhle et al. ..... 439/78
4,940,431 A * 7/1990 Hennemann ..... 439/716
4,969,844 A * 11/1990 Sako et al. ..... 439/733.1
5,032,092 A * 7/1991 Linn ..... 439/723
5,249,979 A 10/1993 Deinhardt et al.
5,292,263 A * 3/1994 Mosser et al. ..... 439/812
5,545,060 A * 8/1996 Gow ..... 439/717
5,658,172 A * 8/1997 Schmidt et al. ..... 439/716
5,741,161 A * 4/1998 Cahaly et al. ..... 439/709
5,764,490 A * 6/1998 Barbier et al. ..... 361/823
5,820,420 A * 10/1998 Bechaz et al. ..... 439/716
5,848,917 A * 12/1998 Bechaz et al. ..... 439/716
5,984,734 A * 11/1999 Piper et al. ..... 439/717
6,019,643 A * 2/2000 Barrat et al. ..... 439/716
6,027,380 A * 2/2000 Hanning et al. ..... 439/716
6,033,268 A * 3/2000 Piper et al. ..... 439/715
6,072,128 A * 6/2000 Ansorge et al. ..... 200/5 R
6,373,259 B1 * 4/2002 Daoud ..... 324/538
6,392,319 B1 * 5/2002 Zebermann et al. ..... 307/147
6,475,036 B2 * 11/2002 Morikawa ..... 439/716

(Continued)

FOREIGN PATENT DOCUMENTS

DE 42 25 573 A1 2/1993

(Continued)

OTHER PUBLICATIONS

Katalog 1, 2004/2005: Produkte für den Schaltschrankbau, Weidmüller GmbH & Co. KG, Paderborn S. K2, K49. Best. Nr.: 5637990000/11/2003.

*Primary Examiner*—T C Patel
*Assistant Examiner*—Vladimir Imas
(74) *Attorney, Agent, or Firm*—Boyle Fredrickson LLP; William R. Walbrun

(57) ABSTRACT

A plug-in module for mounting on a mounting device is provided, the plug-in module including a housing with a rear mounting face and plug regions on the front face. At least one additional plug region is formed between the front face and the rear mounting face on the housing.

8 Claims, 2 Drawing Sheets

U.S. PATENT DOCUMENTS

| | | | | |
|---|---|---|---|---|
| 6,575,783 | B1 * | 6/2003 | Wu | 439/540.1 |
| 6,663,441 | B1 * | 12/2003 | Alexandre et al. | 439/715 |
| 6,736,651 | B2 * | 5/2004 | Ho | 439/79 |
| D525,211 | S * | 7/2006 | Tanabe et al. | D13/162 |

FOREIGN PATENT DOCUMENTS

| | | |
|---|---|---|
| DE | 296 11 543 U1 | 10/1996 |
| DE | 200 00 093 U1 | 6/2001 |

* cited by examiner

PLUG-IN MODULE

This application claims the benefit under 35 USC 119(a)-(d) of German Application No. 20 2006 017 882.1 filed Nov. 22, 2006, the entirety of which is incorporated herein by reference.

FIELD OF THE INVENTION

The invention relates to a plug-in module for mounting on a mounting device.

BACKGROUND OF THE INVENTION

Various embodiments of plug-in modules, in particular plug-in modules in the form of electronic control modules, are already known.

The plug-in control modules are routinely configured such that they can be attached to a standardized mounting rail in a standardized electrical cabinet. Mounting on a top-hat rail (for example DIN top-hat rail 35 mm according to EN 50022) is used by way of example.

Plug-in control modules of this type normally have a significantly greater height than width in relation to a transversely running rail. A large number of plug-in control modules are routinely attached next to one another along the rail.

In some embodiments, snap-action means are provided on the lateral boundary walls, on which another plug-in module is arranged in a row, in order to mechanically connect the plug-in modules which are arranged next to one another.

At least one plug region for inserting one or more plugs is normally provided on the front face of such a plug-in control module. However, the number of plug spaces on the front face of a control module has heretofore been limited.

SUMMARY OF THE INVENTION

The present invention is based on the object of providing a plug-in module of the type mentioned in the introduction which has an extended use area in terms of plug regions.

The invention proceeds from a plug-in module, in particular an electronic plug-in control module. The module is, for example, a control module for a safety device such as a light curtain or the like. The plug-in module can be fitted to a mounting device, for example mounted on a mounting rail on a standardized mounting rail in a standard electrical cabinet. The plug-in module has a housing which comprises a rear mounting face and also at least one plug region on a front face. The core concept of the invention is that at least one additional plug region is formed between the front face and the rear mounting face on the housing. By means of this measure, more plugs can be placed on the plug module in total. Therefore, various plug-in options can be provided, and this permits a flexible wide range of use of such plug-in modules when insertion space is limited.

The front faces of plug-in modules do not necessarily have to be flat. The front face may include stepped areas, curved regions and/or beveled areas.

In a preferred embodiment of the present invention, the at least one additional plug region is formed in a surface of the housing defined by an undercut portion in relation to the front face. Additional surfaces are created by the undercut, in order to be able to arrange plugs. In this case, the plug-in module is preferably configured such that cables are routed to the plug spaces on a face which extends transverse to the planar side regions on which further plug-in modules are arranged in a row relative to one another in each case.

In the case of a housing having an elongate front face and faces adjoining the front face, the undercuts are preferably provided on these typically narrow adjoining faces, possibly over the full width of the plug-in module.

In order to be able to create further plug regions, a plurality of undercuts are preferably provided.

In a preferred embodiment of the present invention, the at least one plug region is arranged in a surface of the undercut which faces towards the front face. Therefore, plugs for a plug region of this type can be oriented in the same way as on the front face of the plug-in module. This saves space for routing the cable in a bent manner.

In a further particularly preferred embodiment of the present invention, two preferably symmetrically arranged undercuts are provided on opposite faces of the housing which run transverse to planar side regions on which the plug-in modules are arranged in a row relative to one another. These are opposite narrow faces in the case of an elongate front face transverse to the direction of arrangement in a row.

In order to further increase the plug options, it is further proposed that a plurality of undercuts which are situated one behind the other, as seen from the front face, are provided. It is also feasible here, in the case of a housing piece between two undercuts, to route the cable past laterally, that is to say on a face on which another plug-in module can be arranged in a row, to an undercut which is situated behind said two undercuts and is intended for a plug for insertion into a plug region. To this end, a corresponding cutout can be provided in order to prevent lateral wear of the cable.

It is also advantageous to provide fixing means for securing a cable of a plug for a plug-in region on a face of the housing which runs transverse to planar side regions. For example, web means can be arranged, possibly in a labyrinthine manner, on a corresponding face in order to be able to relieve the strain on the cable by means of the cable being routed in a crossed-over manner.

In order to further increase the insertion options on the plug-in module, it is also advantageous to provide at least one plug region in the rear mounting face of the housing.

BRIEF DESCRIPTION OF THE DRAWINGS

An exemplary embodiment of the invention is explained in greater detail with reference to the following drawing Figures, with further details of the advantages being specified.

DETAILED DESCRIPTION OF THE INVENTION

Figure 1:
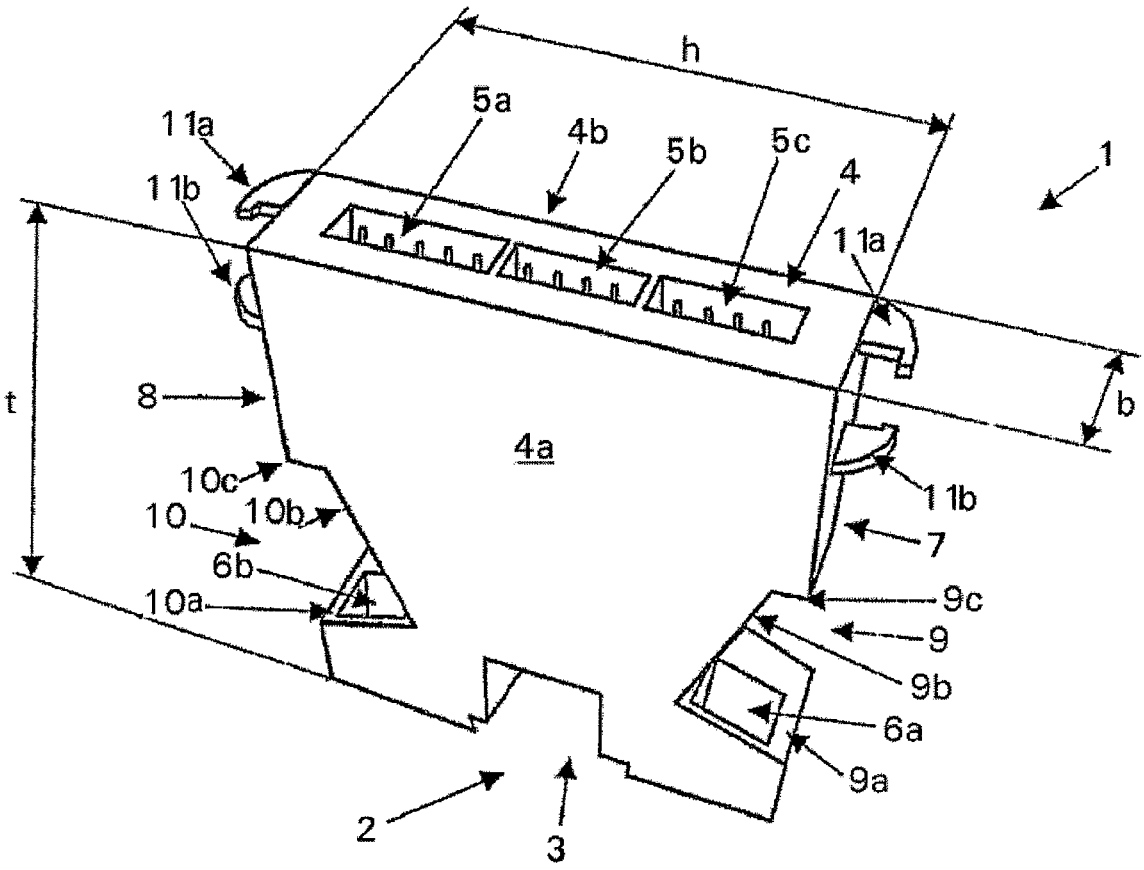
FIG. 1 shows a perspective view of an electronic plug-in control module according to one embodiment of the present invention.

FIG. 1 illustrates an electronic plug-in control module to be attached to a top-hat rail (not depicted). To this end, a suitable recess 3 is formed on a rear mounting face 2 (e.g., a bottom face as shown).

A front face 4 (e.g., a top face as shown) of the plug-in module housing 1 has an elongate configuration, with the longitudinal faces 4*a*, 4*b* representing the faces on which further plug-in modules can be arranged in a row. The space on the front face 4 for arranging plug regions 5*a*, 5*b*, 5*c* is limited since both the insertion width b and also the insertion height h are limited in standardized plug-in modules.

In order to be able to provide further plug regions 6*a*, 6*b*, undercuts 9, are provided on faces 7, 8, which are faces adjoining the front face 4, over the depth t of the plug-in module housing 1. In the exemplary embodiment, the undercuts 9, 10 each substantially have three surfaces, shown here as 9*a*, 9*b*, 9*c* and 10*a*, 10*b*, 10*c*, respectively. In principle, it is feasible to provide one or more plug regions on each of these surfaces. It is also possible to make the geometric shape of the undercut considerably more complex, so that a larger boundary surface of the undercut with further options for attaching plug regions is produced overall.

However, in the present exemplary embodiment, a plug socket, for example an RJ 45 plug socket in this case, is arranged only on the boundary surfaces 9*a*, 10*a* of the undercuts 9 and 10, which are tilted to some extent toward the rear in relation to the front face 4 and which face the front face 4.

In order to be able to reach the respective plug regions 6*a*, 6*b*, a cable can be routed along the respective faces 7, 8.

Retaining lugs 11*a*, 11*b* are provided on the respective faces 7, 8 of the housing in order to fix and relieve the strain on a corresponding cable. The retaining lugs 11*a*, 11*b* are positioned in an offset manner one behind the other in the longitudinal direction of the respective faces 7, 8 and, over the width b of faces 7, 8, are spaced apart from one another in such a way that an inserted cable has to assume a crossed-over course, as a result of which clamping is established.

Figure 2:
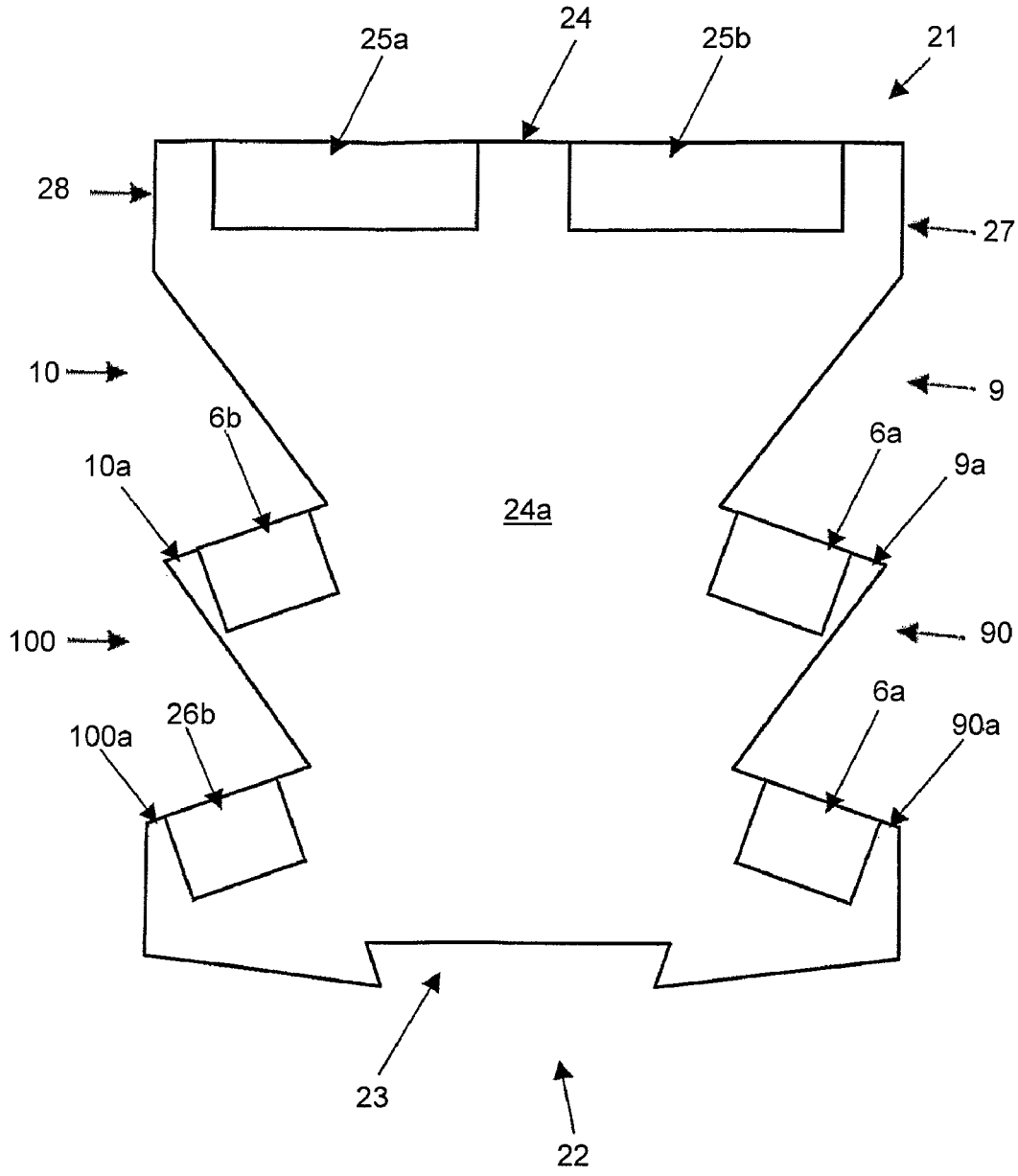
FIG. 2 is a view of an electronic plug-in control module according to another embodiment of the present invention as seen facing a longitudinal face 24*a* thereof.

FIG. 2 shows a view of an electronic plug-in control module housing 21 according to another embodiment of the present invention. In this example, the housing includes a front face 24 (e.g., a top face as shown), having plug regions 25*a* and 25*b* arranged therein. A recess 23 is formed on a rear mounting face 22 (e.g., a bottom face as shown) in a similar manner as shown and described in connection with FIG. 1.

The face 28 adjoining the front face 24 of the housing includes two undercut portions 10 and 100, each having a plurality of surfaces. A plug region 6*b* is provided on a surface 10*a* of undercut 10 and a plug region 26*b* is provided on a surface 100*a* of undercut 100. Similarly, the face 27 adjoining the front face 24 includes two undercut portions 9 and 90, each having a plurality of surfaces, a plug region 6*a* provided on a surface 9*a* of undercut 9 and a plug region 26*b* provided on a surface 90*a* of undercut 90. As shown, the undercuts 10 and 100 on face 28 are situated behind one another as seen from the front face 24. This type of arrangement is also seen with respect to the undercuts 9 and 90 on face 27.

I claim:

1. A plug-in module for mounting on a mounting device, the plug-in module having a housing comprising a rear mounting face, a front face arranged substantially parallel to the rear mounting face, opposed side faces extending between the rear mounting face and the front face, at least one first plug region on the front face, and at least one second plug region formed between the front face and the rear mounting face of the housing, wherein a plurality of undercuts are provided in at least one side face of the housing, each of said undercut being recessed from the at least one side face and forming undercut surfaces; and wherein the at least one second plug region comprises a plug socket which is formed in one of the undercut surfaces.

2. A plug-in module for mounting on a mounting device, the plug-in module having a housing comprising a rear mounting face, a front face arranged substantially parallel to the rear mounting face, opposed side faces extending between the rear mounting face and the front face, at least one first plug region on the front face, and at least one second plug region formed between the front face and the rear mounting face of the housing, wherein at least one undercut is formed in at least one of the side faces, the undercut being recessed from the at least one side face and forming undercut surfaces; and wherein the at least one second plug region comprises a plug socket which is formed in one of the undercut surfaces and wherein the at least one second plug region is arranged in a surface of the undercut surfaces that faces toward the front face.

3. A plug-in module for mounting on a mounting device, the plug-in module having a housing comprising a rear mounting face, a front face arranged substantially parallel to the rear mounting face, opposed side faces extending between the rear mounting face and the front face, at least one first plug region on the front face, and at least one second plug region formed between the front face and the rear mounting face of the housing, wherein a plurality of undercuts are formed in at least one of the side faces, at least one of said plurality of undercuts being recessed from the at least one side face and forming undercut surfaces; and wherein the at least one second plug region comprises a plug socket which is formed in one of the undercut surfaces at a distance from the at least one side face, and wherein the plurality of undercuts are situated one behind the other as seen from the front face.

4. The plug-in module as claimed in claim 2, further comprising at least a fixing member for securing a cable of a plug for at least the second plug-in region provided on at least one side face of the housing.

5. The plug-in module as claimed in claim 2, wherein the at least one undercut in the at least one side face of the housing is arranged symmetrically with respect to the at least one undercut in the other side face of the housing.

6. The plug-in module as claimed in claim 3, comprising at least a pair of fixing members provided on the at least one side face of the housing and arranged in a laterally and vertically spaced apart relation with respect to one another on the at least one side face of the housing.

7. A plug-in module for mounting on a mounting device, the plug-in module having a housing comprising a rear mounting face, a front face arranged substantially parallel to the rear mounting face, opposed side faces extending between the rear mounting face and the front face, at least one first plug region located on the front face, and at least one second plug region located between the front face and the rear mounting face, wherein a longitudinal extension axis of the first plug region extends perpendicularly with respect to the front face, a longitudinal extension axis of the second plug region extends at an acute angle relative to the longitudinal extension axis of the first plug region, and the second plug region is positioned within a projected area of the front face.

8. The plug-in module as claimed in claim 7, wherein said acute angle is less than 45°.

* * * * *

UNITED STATES PATENT AND TRADEMARK OFFICE

CERTIFICATE OF CORRECTION

PATENT NO. : 7,699,668 B2
APPLICATION NO. : 11/942995
DATED : April 20, 2010
INVENTOR(S) : Michael S. Osvatic It is certified that error appears in the above-identified patent and that said Letters Patent is hereby corrected as shown below:

Col. 2, line 67 After "9," insert --10--.

Signed and Sealed this

Seventh Day of September, 2010

David J. Kappos

David J. Kappos
*Director of the United States Patent and Trademark Office*